United States Patent [19]

Bachman et al.

[11] 4,359,213

[45] Nov. 16, 1982

[54] TENSION CLAMP FOR THREE OR MORE DIRECTION STRING NETWORKS

[76] Inventors: Charles W. Bachman, 11 Percy Rd., Lexington, Mass. 02173; J. Cary Bachman, 6040 N. Lydell Ave., Milwaukee, Wis. 53217

[21] Appl. No.: 113,482

[22] Filed: Jan. 21, 1980

[51] Int. Cl.[3] ..... B25B 1/00

[52] U.S. Cl. ..... 269/153; 269/154; 269/228; 269/257; 269/909; 273/73 A

[58] Field of Search ..... 273/73 A, 73 B; 269/909, 257, 228, 152, 154, 153

[56] References Cited

U.S. PATENT DOCUMENTS 3,913,912 10/1975 Smith ..... 273/73 A 4,049,268 9/1977 Ray ..... 273/73 A

*Primary Examiner*—Robert C. Watson

*Attorney, Agent, or Firm*—Kenway & Jenney

[57] ABSTRACT

Apparatus for clamping one string of a three or more direction oriented string network of a game racket held in a support fixture, to that support fixture. The apparatus includes a pair of jaws adapted to be selectively biased against the string-to-be-clamped in the string network. The jaws include a portion adapted for extension through the openings between the strings of the network, including a plurality of teeth defined by intertooth grooves having angular orientations and spacings matching the angular orientations and spacings of the strings crossing the string-to-be-clamped in the network. In another form, an apparatus for selectively clamping two adjacent parallel strings of a three or more direction oriented string network in a game racket includes two pairs of jaws adapted for clamping the two strings. The jaws include a portion adapted for extension through the openings between the strings in the network, including a plurality of teeth defined by intertooth grooves having angular orientations and spacings matching the angular orientations and spacings of the strings crossing the two strings-to-be-clamped in the string network.

10 Claims, 6 Drawing Figures

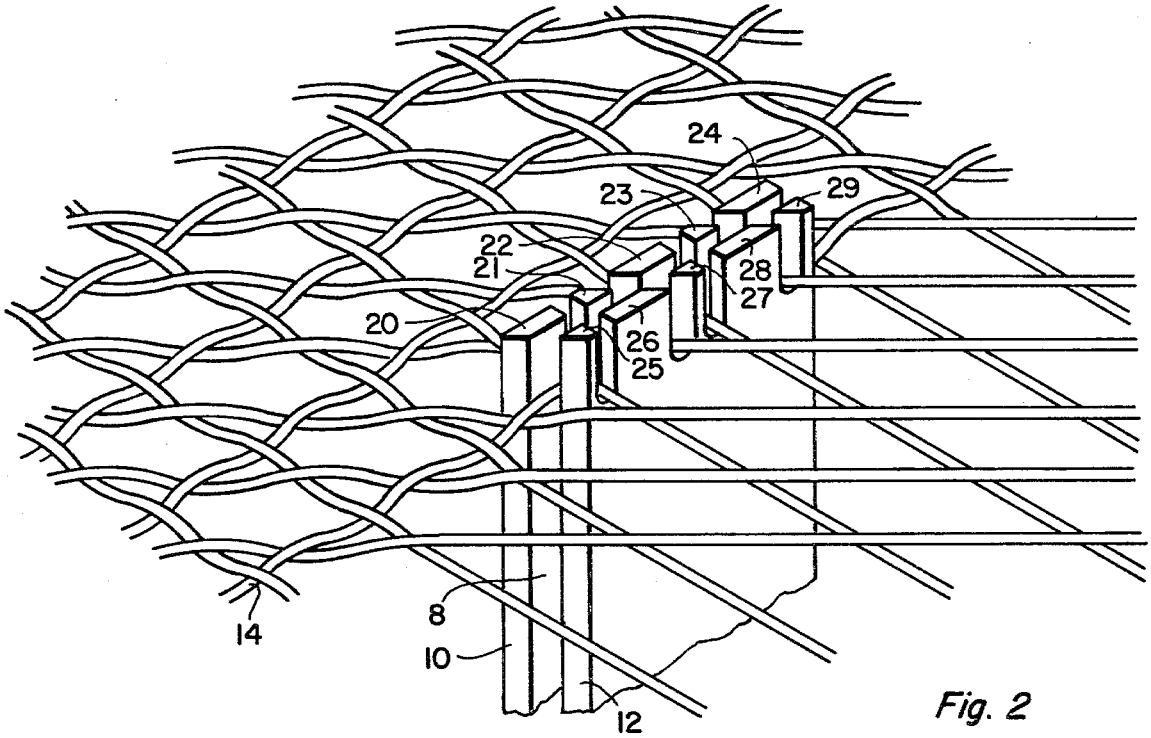
Fig. 2
Fig. 3
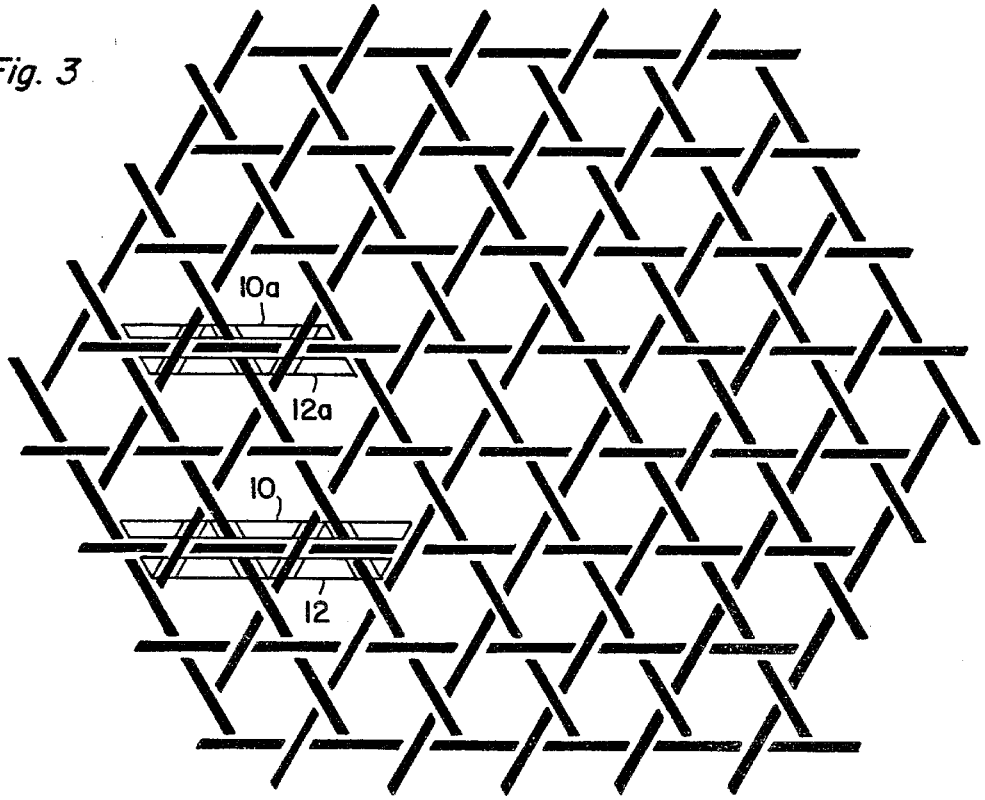

TENSION CLAMP FOR THREE OR MORE DIRECTION STRING NETWORKS

REFERENCE TO RELATED PATENT APPLICATION

The subject matter of this application is related to that of U.S. patent application Ser. No. 113,556, entitled "Game Racket With Three Or More Direction Oriented String Network," filed on even date herewith. The latter application is incorporated herein by reference.

BACKGROUND OF THE INVENTION

This invention relates to tennis and other game rackets, and in particular to devices used in stringing such rackets.

Conventional tennis rackets are generally strung in a string network having a rectangular grid pattern, using the "basketweave" or some minor variation of the basketweave. Generally, a long string is used with a string support so that the string passes back and forth across the racket face to form the various strings in the pattern. There are many well-known stringing machines which are used to aid in such stringing of rackets. With these machines, the racket to be strung is held firmly in the machine. When the operator threads a string across the racket head, that string is held in tension until it is either tied off or held in tension by the tensioning of the next string in the network. Typically, this tensioning is achieved by one of two different methods.

The first string tensioning method involves the use of a "one-string" clamp which is attached to the racket stringing machine. The one-string clamp includes a "mouth" defined by a single set of "jaws" which may be selectively closed about a string-to-be-held-in-tension. The one-string clamp is adapted so that it may be simultaneously clamped tightly to the string-to-be-held-in-tension, and to the racket stringing machine. Thus, with the racket held firmly in the machine and the string held tightly to the machine, the string is held tight with regard to the racket. An exemplary form of such a stringing machine (having a one-string clamp, is the Model Serrano 6000, manufactured by Tennis Machines Inc., St. Louis, Mo.

The second conventional string tensioning method involves the use of a "two-string" clamp. The two-string clamp generally includes two mouths and two pairs of jaws. In use, the jaws of one mouth are clamped onto a first string which is already firmly held under tension and the jaws of the second mouth are clamped onto the new string-to-be-held-in-tension. In this case the clamp has no attachment to the racket stringing machine and the new string is held in position with regard to the racket because the previously tensioned string is holding the clamp in position with regard to the racket. An exemplary form of such a two-string clamp is the Model Century Superclamp, distributed by Century Sports, Plainfield, Mo.

The one-and two-string clamps used with the conventional grid string pattern have teeth cut into the ends of the jaws to allow insertion into a partially strung grid without causing any interference with the strings that have already been inserted perpendicularly to the strings currently being clamped under tension.

While such clamps are well suited for use in stringing conventional ninety degree grid networks, the clamps may not be used to string the three or more direction oriented string networks disclosed in the incorporated reference. In one form of those networks (having three string sets), the various strings-to-be-held-in-tension intersect at sixty and one hundred twenty degrees from the new strings being tensioned and clamped. Thus, the cut of the teeth of the clamps designed for the grid pattern cannot be used to clamp the new strings being inserted into a three direction strung racket.

Accordingly, it is the primary object of the present invention to provide a "one-string" clamp with teeth designed to be inserted into a three or more direction strung network and to hold a new string under tension until it can be tied off or until the next string can be placed under tension.

It is another object of the invention to provide a "two-string" clamp with teeth designed to be inserted into a three or more direction strung network and to hold a new string under tension until it can be tied off or until the next string can be placed under tension.

BRIEF DESCRIPTION OF THE DRAWINGS

FIG. 2 illustrates an isometric view of the pair of jaws and the teeth of a one-string clamp embodying the present invention;

FIG. 3 illustrates a top view of the teeth of the one-string clamp, showing the manner in which the two sets of teeth are cut so that they may be inserted into the three direction orientation string network and clamp upon a single string;

SUMMARY OF THE INVENTION

Figure 1:
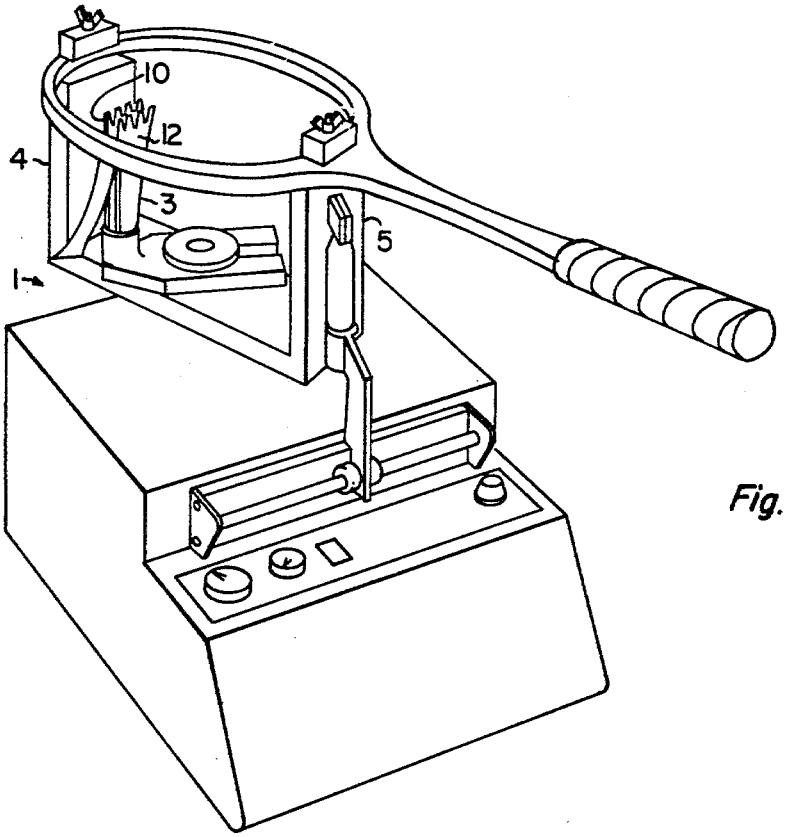
FIG. 1 shows a racket stringing machine and one-string clamp embodying the present invention.

One form of the invention is an apparatus for selectively clamping one string of a three or more direction oriented string network of a game racket held in a support fixture, to the support fixture. The apparatus includes a mouth defined by opposing planar surfaces of two jaws coupled so that the planar surfaces lie opposite each other. A selectively operative mechanism is adapted for biasing the opposed planar surfaces towards each other. In addition, a selectively operative mechanism is adapted for both coupling the jaws to the support fixture and for supporting the jaws with respect to the frame held in that fixture so that a portion of the jaws extends through the planar opening defined by the frame of the racket. That portion of the jaws includes a plurality of teeth adapted to extend between the strings of the network. The teeth are defined by inter-tooth grooves having a width at least equal to a predetermined value, such as the diameter of the various strings in the network. The inter-tooth grooves have angular orientations and spacings which match the angular orientations and spacings of the strings crossing the string-to-be-clamped in the string network.

The teeth may be tapered to have cross-sections which decrease with distance from the portion of the jaws opposite the teeth. Furthermore, in a particular form of the invention, the teeth may have substantially trapezoidal cross-sections characterized by equal base vertex angles, where the term "base" refers to the longer of the two parallel sides forming the trapezoid. In yet other embodiments, the cross-sections of the teeth may be both trapezoidal and triangular, with vertex angles substantially equalling 60 degrees and 120 degrees.

The invention may also be adapted for selectively clamping two adjacent parallel strings of a three or more direction oriented string network in a game racket. In this form, the clamping apparatus includes two mouths, each of which is defined by opposing planar surfaces of a pair of jaws. Each of the jaws may be separate elements or, alternatively, two of the jaws (one from each mouth) may be positioned back-to-back on a single element. The clamping apparatus further includes a selectively operative mechanism for biasing the opposed planar surfaces of each of the pairs of jaws towards each other.

A portion of the ends of both sets of jaws consists of a plurality of teeth adapted to extend through the planar opening defined by the game racket and between the strings in the network. The teeth are defined by inter-tooth grooves having a width at least equal to a predetermined value (such as the string diameter). The grooves have angular orientations and spacings which match the angular orientations and spacings of the strings crossing the two strings-to-be-clamped in the string network when the planar surfaces are biased towards each other.

The teeth may be tapered to have cross-sections which decrease with distance from the portion of the jaws opposite the teeth. In various embodiments, the teeth may have substantially trapezoidal, triangular and hexagonal cross-sections where the trapezoidal and triangular cross-sections may be characterized by equal base vertex angles. In some forms of the invention, these inventions may be substantially equal to 60 degrees and 120 degrees.

DESCRIPTION OF THE PREFERRED EMBODIMENT

FIG. 1 shows a racket stringing machine 1 having a one-string clamp 3 embodying the present invention. The machine 1 includes frame members 4 and 5 which serve as a support fixture for a game racket-to-be-strung. FIG. 2 shows the mouth 8 and jaws 10 and 12 (defining that mouth) of the one-string clamp 3. The jaws 10 and 12 are shown in an operative position to clamp string 14 of a partially strung "snowshoe weave" string network (having a weave pattern as described in conjunction with FIG. 1 of the incorporated reference. The jaws 10 and 12 include a plurality of teeth (denoted by reference designations 20–29) at their outermost points. The teeth 20–27 have specific cross-sectional shapes and placements in order to accommodate the triangular and hexagonal spaces formed by the intersecting strings in the string network. The teeth of the illustrated embodiment of jaws 10 and 12 have a substantially uniform cross-section throughout their length. However, it will be understood that the teeth of alternate embodiments may be tapered to permit ease of insertion into a partially strung string network.

FIG. 3 illustrates a top view of the jaws 10 and 12 and the portion of a string network similar to that shown in FIG. 1, showing the jaws 10 and 12 as seen from the side of the string network opposite to the body of the clamp. In this embodiment, the five teeth in each of jaws 10 and 12 have alternately large and small trapezoidal cross-sections. FIG. 3 also shows an end view of four-tooth jaws 10*a* and 12*a* of an alternate form of the invention. Other variations in the jaws, particularly with regard to the number of teeth and size and shape of the first tooth at a particular end of the jaws, fall within the scope of the invention.

A one-string clamp employing the jaws 10 and 12 may be used in conjunction with a racket stringing machine which firmly holds a tennis racket while it is being strung. Such a one-string clamp is pivotally mounted on the racket stringing machine such that it is free to move and be aligned with a string being newly placed in the racket. In one form, the stringing machine (such as a Model Serrano 6000, manufactured by Tennis Machines Inc., St. Louis, Mo.) may permit the clamp to be selectively positioned at various orientations along orthogonal axes. In an alternate form, the stringing machine (such as a Model Electromatic, manufactured by Court and Slope, Elgin, Ill.) may permit the clamp to be selectively positioned at various orientations along an arm which may be selectively pivoted and locked.

With this configuration, after a string has been threaded through the tennis racket face and pulled to the desired level of tension, the clamp is adjusted such as to insert its teeth into the face of the racket, with the jaws positioned on opposite sides of the string-which-is-to-be-held-in-tension. When the clamp is tightened, the clamp is then tightened to simultaneously both hold the new string under tension and affix itself firmly to the mounting bracket on the racket stringing machine. When so tightened, the clamp holds the newly tensioned string at the desired level of tension until the new string can be tied off or until it can be threaded through the frame to form the next string in the network and again be placed under tension. The clamp can then be loosened and moved on its bracket and reclamped on the new string. The stringing, tensioning, and clamping operations are repeated until the racket is completely strung and tied off.

The clamp may be attached to the stringing machine in a conventional manner, for example, with a single mechanism that clamps both the jaws 10 and 12 to a string and the clamp assembly itself to a desired position in relation to the stringing machine. Alternatively, separate mechanisms may be incorporated to clamp the jaws 10 and 12 to a string and to clamp the clamp assembly in relation to the stringing machine. In such embodiments, the portion of the clamping assembly holding the jaws 10 and 12 may be pivotable with respect to the portion which is clamped to the stringing machine, in order to permit various orientations of the jaws 10 and 12 with respect to the string network of a racket held by the machine.

Figure 4:
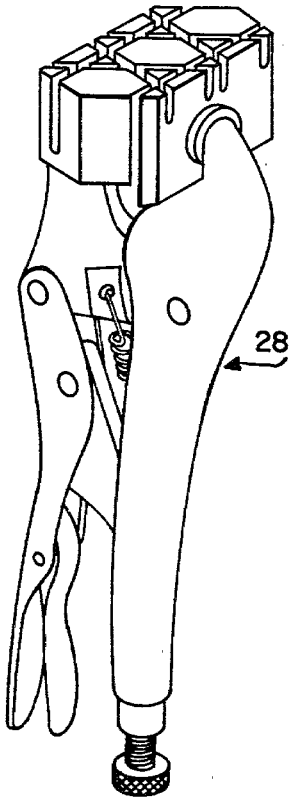
FIG. 4 shows a two-string clamp embodying the present invention.
Figure 5:
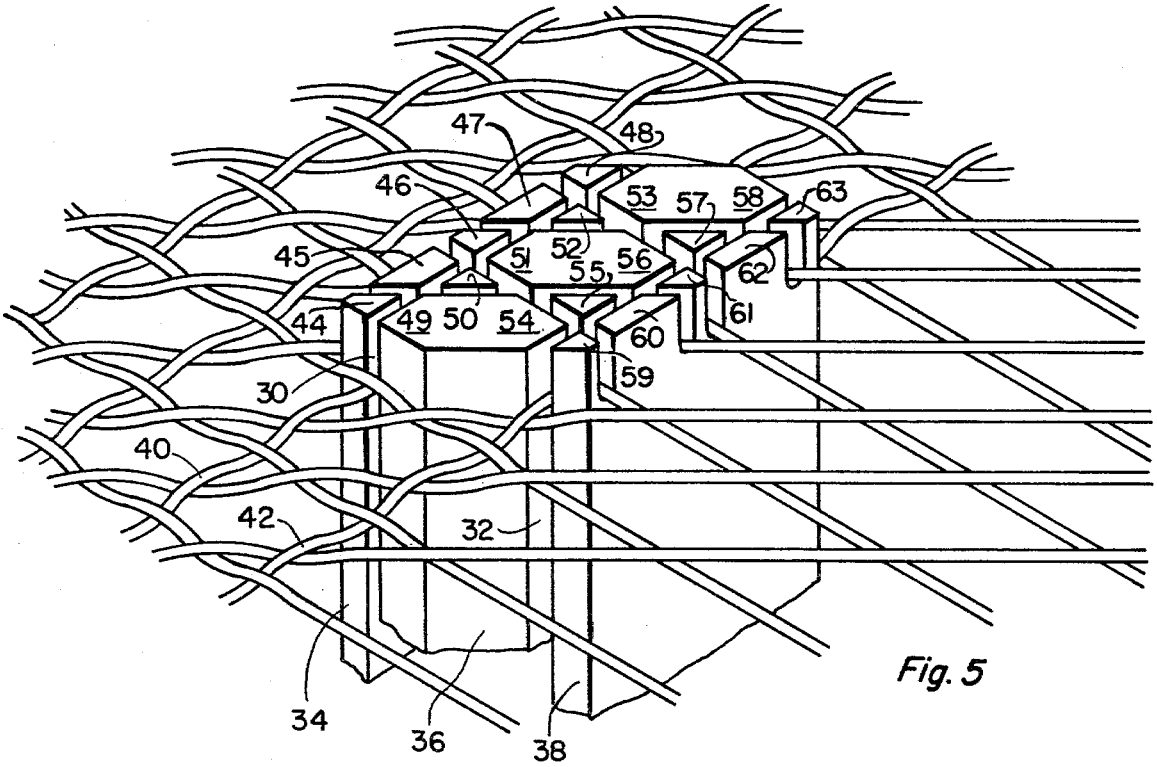
FIG. 5 illustrates an isometric view of the two pairs of jaws and the teeth of a two-string clamp embodying the present invention.

FIG. 4 shows a two-string clamp 28 embodying the present invention. FIG. 5 shows the mouths 30 and 32 and jaws 34, 36 and 38 (defining those mouths) of a two-string clamp of FIG. 4 in detailed form. In this configuration, the jaw element 36 is captively held to "float" between the jaw element 34 and 38, for example, by way of a support member (not shown) which is pivotally coupled about the axis at pivot point 28*a* of clamp 28. The jaws 34 and 36 are shown in an operative position to clamp string 40 of a partially strung snowshoe weave string network. Similarly, jaws 36 and 38 are shown in an operative position to clamp string 42 of the partially strung string network. In the present embodiment, element 36 functions as one of the jaws defining both mouths 30 and 32. In alternate embodiments, separate jaw elements may be used.

In the present embodiment, the two-strung clamp includes a conventional mechanism to simultaneously clamp the string segments 40 and 42 in jaws 34, 36 and 38.

As shown, the jaws 34 and 36 of mouth 30 include teeth 44–53, and the jaws 36 and 38 of mouth 32 include teeth 54–63. The teeth 44–63 have specific cross-sectional shapes and placements so that they accommodate the triangular and hexagonal spaces formed by the intersecting strings in the string network. Again, the teeth of the illustrated embodiment of jaws 34, 36 and 38 have a substantially uniform cross-section throughout their length, however, the teeth of alternate embodiments may be tapered to permit ease of insertion into a partially strung string network.

Figure 6:
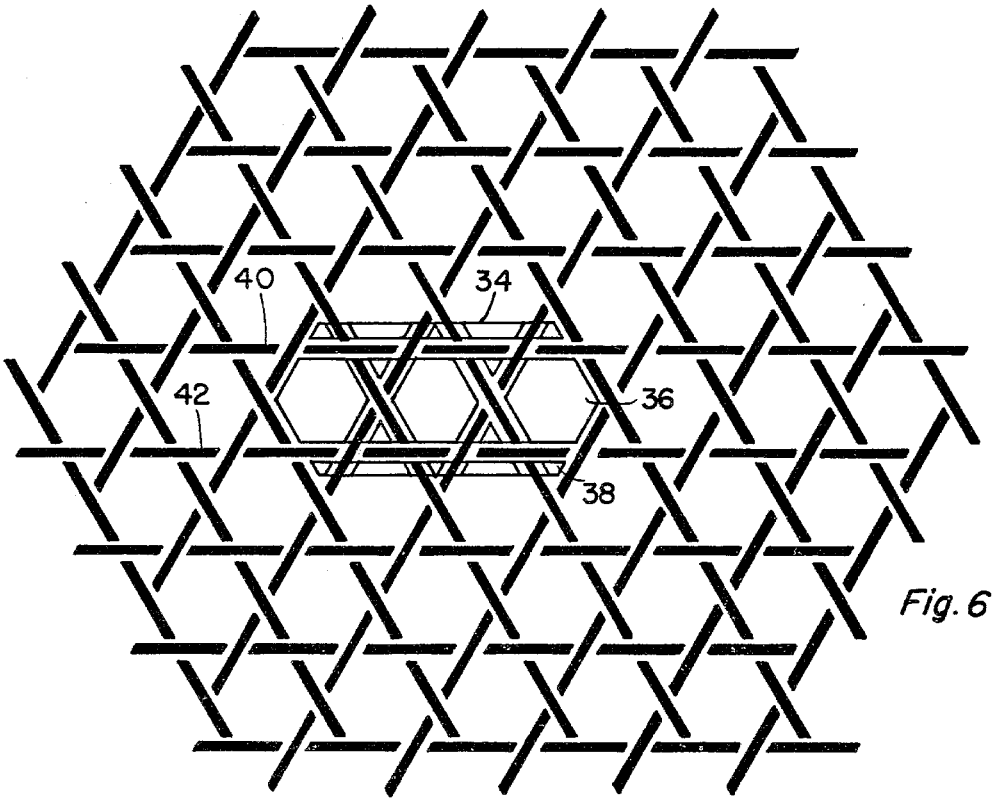
FIG. 6 illustrates a top view of the teeth of the two-string clamp, showing the manner in which the three sets of teeth are cut so that they may be inserted into the three direction orientation string network and clamp upon a pair of adjacent parallel strings.

FIG. 6 illustrates a top view of the jaws 34, 36 and 38 and the portion of a string network similar to that shown in FIG. 5, showing the jaws as seen from the side of the string network opposite to the body of the clamp. In this embodiment, the five teeth in each of jaws 34 and 38 have alternately large and small trapezoidal cross-sections. The teeth of jaw 36 are defined by the portions of that element having hexagonal and triangular cross-sections. Other variations in the jaws, particularly with regard to the number of teeth and size and shape of the first tooth at a particular end of the jaws, fall within the scope of the invention.

A two-string clamp employing the jaws 34, 36 and 38 may be used in conjunction with a racket stringing machine which holds a tennis racket while it is being strung. Such a two-string clamp is not generally connected to the racket stringing machine, but rather may be selectively positioned anywhere within the racket face.

The two-string clamp is designed to be used in conjunction with a stringing machine but without attachment to the machine. By way of example, after string 40 has been inserted in a game racket, tensioned and held it under tension, the string 42 (adjacent to and running parallel with the string 40) is inserted and placed under tension. The clamp inserted into the racket from either the top or the bottom, with jaws 34 and 36 straddling the first string 40 and the jaws 36 and 38 straddling the second string 42. Preferably, the clamp is positioned close to the edge of the racket where the loose end of the string 42 is being held under tension. The clamp is then tightened so that both strings 40 and 42 are held tightly by the jaws 34, 36 and 38. At this point, the loose end of the string can be released from the tensioning device and threaded through the racket to form the next string. When this string has been placed under tension, the two-string clamp may be released from the strings 40 and 42 and reclamped on the string 42 and that "next" string preferably at the side of the racket where the loose end is being held under tension. This action is continued until all the strings in one direction are finished and the string is tied off or is used as the first string in a new direction. Each time the clamp uses the previously secured (or Nth) string to hold the next (or N+1th) string under tension until it can be secured.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Apparatus for selectively clamping one string of a three or more direction oriented string network in a substantially planar opening defined by the frame of a game racket held in a support fixture to said support fixture, comprising:

A. a mouth defined by opposing substantially planar surfaces of two jaws and associated means for coupling said jaws with said planar surfaces opposite each other, B. selectively operative means for biasing said opposed planar surfaces towards each other, C. selectively operative means for coupling said jaws to said support fixture and for supporting said jaws with respect to said frame so that a portion of said jaws extends through said planar opening, wherein the portion of said jaws adapted for extension through said planar opening between strings of said network, consist of a plurality of teeth, said teeth being defined by inter-tooth grooves having a width at least equal to a predetermined value and having angular orientations and spacings matching the angular orientations and spacings of strings crossing said one string in said string network when said biasing means is operative, wherein said teeth have substantially trapezoidal cross-sections characterized by equal base vertex angles.

2. Apparatus for selectively clamping one string of a three or more direction oriented string network in a substantially planar opening defined by the frame of a game racket held in a support fixture to said support fixture, comprising:

A. a mouth defined by opposing substantially planar surfaces of two jaws and associated means for coupling said jaws with said planar surfaces opposite each other, B. selectively operative means for biasing said opposed planar surfaces towards each other, C. selectively operative means for coupling said jaws to said support fixture and for supporting said jaws with respect to said frame so that a portion of said jaws extends through said planar opening, wherein the portion of said jaws adapted for extension through said planar opening between strings of said network, consist of a plurality of teeth, said teeth being defined by inter-tooth grooves having a width at least equal to a predetermined value and having angular orientations and spacings matching the angular orientations and spacings of strings crossing said one string in said string network when said biasing means is operative, wherein said teeth have substantially trapezoidal and triangular cross-sections characterized by equal base vertex angles.

3. Apparatus according to claim 1 or 2 wherein said cross-sections have vertex angles substantially equal to 60° and 120°.

4. Apparatus for selectively clamping two adjacent parallel strings of a three or more direction oriented string network in a substantially planar opening defined by the frame of a game racket, comprising:

A. two mouths, each being defined by opposing substantially planar surfaces of a pair of jaws, and associated means for coupling the jaws of each of said pairs with said planar surfaces opposite each other, wherein a portion of the end of said jaws consist of a plurality of teeth adapted to extend through said planar opening between strings in said network, said teeth being defined by inter-tooth grooves having a width at least equal to a predetermined value and having angular orientations and spacings matching the angular orientations and spacings of strings crossing said two strings in said string network when said biasing means is operative, wherein said teeth have substantially trapezoidal cross-sections characterized by equal base vertex angles.

5. Apparatus for selectively clamping two adjacent parallel strings of a three or more direction oriented string network in a substantially planar opening defined by the frame of a game racket, comprising:

A. two mouths, each being defined by opposing substantially planar surfaces of a pair of jaws, and associated means for coupling the jaws of each of said pairs with said planar surfaces opposite each other, B. selectively operative means for biasing said opposed planar surfaces of each of said pairs of jaws towards each other, wherein a portion of the end of said jaws consist of a plurality of teeth adapted to extend through said planar opening between strings in said network, said teeth being defined by inter-tooth grooves having a width at least equal to a predetermined value and having angular orientations and spacings matching the angular orientations and spacings of strings crossing said two strings in said string network when said biasing means is operative, wherein said teeth have substantially trapezoidal and triangular cross-sections characterized by equal base vertex angles.

6. Apparatus for selectively clamping two adjacent parallel strings of a three or more direction oriented string network in a substantially planar opening defined by the frame of a game racket, comprising:

A. two mouths, each being defined by opposing substantially planar surfaces of a pair of jaws, and associated means for coupling the jaws of each of said pairs with said planar surfaces opposite each other, B. selectively operative means for biasing said opposed planar surfaces of each of said pairs of jaws towards each other, wherein a portion of the end of said jaws consist of a plurality of teeth adapted to extend through said planar opening between strings in said network, said teeth being defined by inter-tooth grooves having a width at least equal to a predetermined value and having angular orientations and spacings matching the angular orientations and spacings of strings crossing said two strings in said string network when said biasing means is operative, wherein one jaw from each of said pairs are positioned back-to-back in a single element.

7. Apparatus according to claim 6 wherein said teeth of said back-to-back jaws have substantially triangular and hexagonal cross-sections.

8. Apparatus according to claim 7 wherein said teeth of the other jaws have substantially trapezoidal cross-sections characterized by equal base vertex angles.

9. Apparatus according to claim 7 wherein said teeth of the other jaws have substantially trapezoidal and triangular cross-sections characterized by equal base vertex angles.

10. Apparatus according to claim 4 or 5 or 8 or 9 wherein said cross-sections have vertex angles substantially equal to 60° and 120°.

* * * * *